US006776403B1

(12) United States Patent
Neufeld

(10) Patent No.: US 6,776,403 B1
(45) Date of Patent: Aug. 17, 2004

(54) HAND TOOL FOR PORTABLY HOLDING WORKPIECES DURING DRILLING OR GRINDING OPERATIONS

(76) Inventor: George Neufeld, 227 Douglas Woods Drive S.E., Calgary, Alberta (CA), T2Z 2E7

( * ) Notice: Subject to any disclaimer, the term of this patent is extended or adjusted under 35 U.S.C. 154(b) by 0 days.

(21) Appl. No.: 10/401,741

(22) Filed: Mar. 31, 2003

(51) Int. Cl.[7] ..... B25B 1/20
(52) U.S. Cl. ..... 269/6; 269/152; 269/37; 269/45
(58) Field of Search ..... 269/6, 152, 37, 269/45

(56) References Cited

U.S. PATENT DOCUMENTS 2,836,139 A * 5/1958 Holmberg ..... 269/45
4,943,039 A * 7/1990 Jackson ..... 269/45

* cited by examiner

*Primary Examiner*—Robert C. Watson
(74) *Attorney, Agent, or Firm*—Lance A. Turlock

(57) ABSTRACT

A hand tool for portably holding a workpiece during drilling or grinding operations is disclosed. The tool comprises first and second locking pliers and a bracing arrangement therebetween. By reason of the bracing arrangement, the tool is able to securely hold the workpiece without loss of grip while torques in excess of that which could be sustained by a single pliers or by two pliers acting independently are applied to the workpiece.

13 Claims, 3 Drawing Sheets

HAND TOOL FOR PORTABLY HOLDING WORKPIECES DURING DRILLING OR GRINDING OPERATIONS

BACKGROUND OF THE INVENTION

It is common practice to hold a workpiece with locking pliers while grinding edges or other parts of the workpiece with a grinding machine. Likewise, it is common practice when drilling a small workpiece to hold the workpiece in a desired position with locking pliers in one hand while manipulating a machine such as a drill press with the other hand.

In either situation, the pliers will lose grip on the workpiece if the machine in question imposes a torque or twisting force sufficient to overcome the gripping force of the pliers. The problem can be exacerbated if the gripping force is not uniformly distributed over the surface area of the grip. While the gripping force applied by locking pliers may be substantial, the hold or resistance offered by the grip will be weakened if it is concentrated to a point contact with the workpiece. This problem may accrue because either the workpiece or the pliers or both, have irregularly machined working surfaces. For the workman, the result is often a frustrating loss of grip which impedes the work at hand and which can lead to damage to the workpiece.

Accordingly, there is a need for a new and improved apparatus to portably hold workpieces during drilling, grinding or similar operations.

The prior art is replete with designs for locking pliers or clamps. This includes locking pliers that have been marketed and sold for years under the trademark VISE-GRIP design variations thereof; see also U.S. Pat. No. 2,563,267 (Petersen) granted on Aug. 7, 1951. Other examples include those disclosed in the following U.S. patents: U.S. Pat. No. 5,385,072 (Neff) granted on Jan. 31, 1985; U.S. Pat. No. 4,730,524 (Petersen) granted on Mar. 15, 1988; U.S. Pat. No. 5,460,065 (Balmer) granted on Oct. 24, 1995; U.S. Pat. No. 5,765,822 (Mead) granted on Jun. 16, 1998; U.S. Pat. No. 5,992,273 (Galea) granted on Nov. 30, 1999; U.S. Pat. No. 6,000,686 (Yates) granted on Dec. 14, 1999; U.S. Pat. No. 6,012,361 (Wooster et al.) granted on Jan. 11, 2000.

The prior art is sparse with examples of designs which advocate the use of a pair of locking pliers or clamps. Those of which the applicant is aware are directed to situations where one of the pair of pliers or clamps is used to hold a workpiece while the other is used for connection with a supporting structure such as a table, thereby allowing the workpiece to be held in a desired angular position relative to the table: see U.S. Pat. No. 1,352,647 (Benton) granted on Sep. 14, 1920 and U.S. Pat. No. 5,058,869 (Ruthven) granted on Oct. 22, 1991. None of these examples address or contemplate the situation where a workman uses an locking pliers or a clamp to portably hold a workpiece during drilling, grinding or similar operations. Further, they do not address the problem which leads to the undesirable loss of grip on a workpiece during machining operations.

BRIEF SUMMARY OF THE INVENTION

In accordance with a broad aspect of the present invention, there is provided a hand tool is for portably holding a workpiece, the tool comprising first and second locking pliers for concurrently gripping the workpiece with a lockable grip, and a bracing member for restraining relative movement between the pliers while both of the pliers concurrently grip the workpiece. Each of the pliers comprises a first elongated handle member having a fixed jaw member at one end and opposed sides; a movable jaw member pivotally connected to the first handle member for movement on a pivot axis between an open position and a closed position in relation to the fixed jaw member; a second handle member pivotally connected to the movable jaw member for moving the movable jaw member between its open and closed positions; and a locking mechanism for releasably locking the movable jaw member in its closed position. The bracing member extends from the first handle member of one of the pliers. When the pliers concurrently grip the workpiece, the bracing member serves to restrain relative movement between the pliers by engaging an abutment carried by the first handle member of the other one of the pliers.

With the use of first and second locking pliers and a bracing member therebetween, an improved grip on a workpiece can be achieved. In other words, the torque required to twist a workpiece from the grip of the two pliers when they are braced in accordance with the present invention is greater (and can be substantially greater) than the torque required to twist the workpiece from the grip of the two pliers when they are not braced.

In one embodiment, the bracing member comprises an elongated bracing pin which extends on a longitudinal axis transversely from the first handle member of one of the pliers, and a pin abutment fixed to the first handle member of the other one of the pliers to provide an abutment for the bracing pin. The pin abutment may comprise a socket sized to longitudinally receive the bracing pin. In a preferred embodiment, the bracing pin is connected to and is preferably integrally formed with the jaw pivot pin of a first one of the pliers, and the pin socket is connected to and is preferably integrally formed with the jaw pivot pin of the other one of the pliers.

Advantageously, the pin socket is sized not only to longitudinally receive the bracing pin but also to permit angular movement of the bracing pin within the socket in a plane perpendicular to the longitudinal axis of the bracing pin. This allows the socket to provide an abutment for the bracing pin while the pliers are angled towards each other for the purpose of concurrently gripping a relatively small workpiece.

In another embodiment, there is provided a hand tool for portably holding a workpiece, the tool comprising first and second locking pliers having substantially the same construction including a first pin socket connected to the first handle member of a first one of the pliers; a second pin socket connected the first handle member of a second one of the pliers: and an elongated bracing pin extending on a longitudinal axis. One end of the bracing pin is longitudinally receivable within the first pin socket while an opposed end of the bracing pin is longitudinally received within the second pin socket. The pin sockets are for concurrently abuttingly engaging the bracing pin while both of the pliers concurrently grip the workpiece. This embodiment enables the use of first and second locking pliers that are substantially the same in construction. Further, as will become apparent hereinafter, this embodiment may incorporate added features like those described above.

The foregoing and other features and advantages of the present invention will now be described in more detail with reference to the drawing.

DETAILED DESCRIPTION OF THE INVENTION

Figure 1:
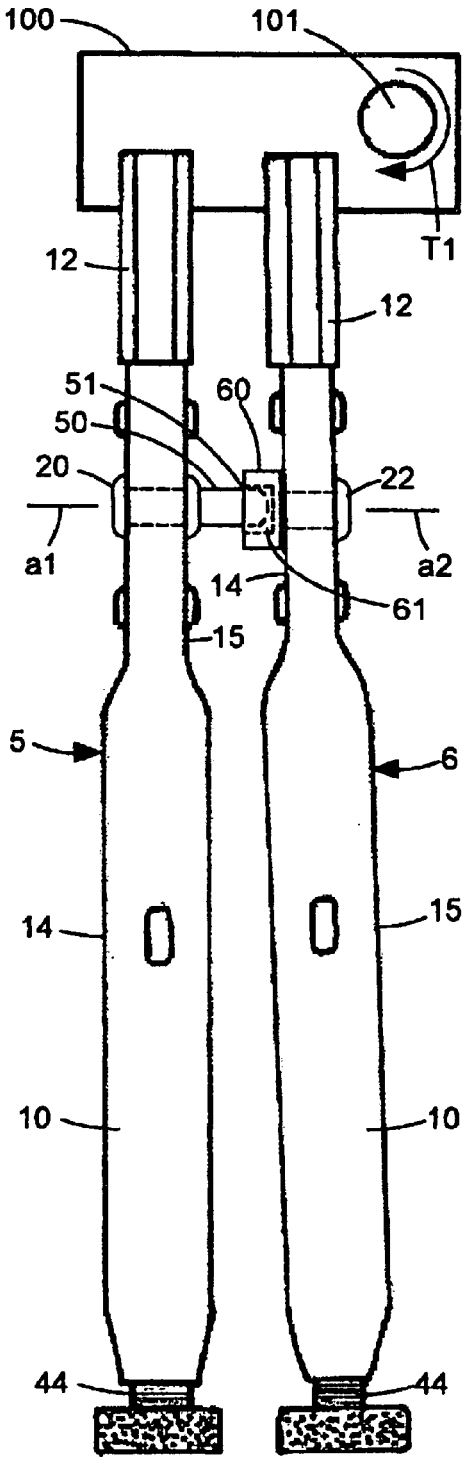
FIG. 1 is a top view of a hand tool in accordance with the present invention shown while gripping a rectangular workpiece.
Figure 2:
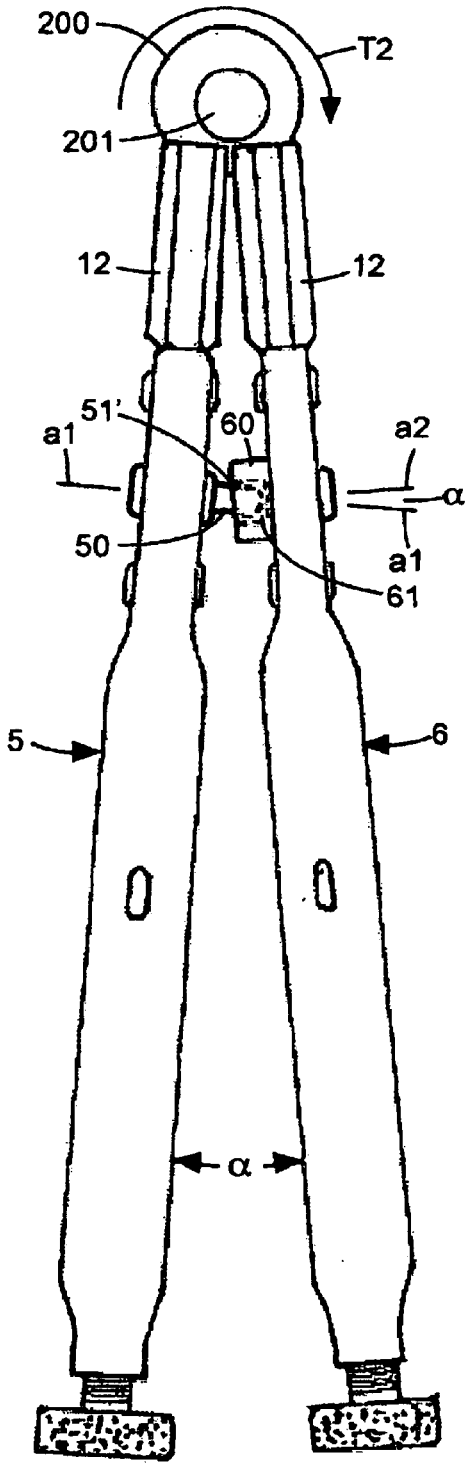
FIG. 2 is a top view of the hand tool shown in FIG. 1 shown while gripping a circular workpiece somewhat smaller than the workpiece shown in FIG. 1.

Referring now to the drawing, and initially FIGS. 1–7 there is shown a hand tool generally designated 1 comprising first and second locking pliers generally designated 5, 6. In FIG. 1, the pliers are shown concurrently gripping a thin rectangular workpiece 100 (not part of the present invention) through which a hole 101 has been drilled. In FIG. 2, the pliers are shown concurrently gripping a smaller circular workpiece 200 (likewise not part of the present invention) through which a hole 201 has been drilled. The pliers are individually shown in FIGS. 3 and 4.

But for modifications implementing the present invention, the construction of pliers 5 and pliers 6 is substantially the same. Each pliers comprises an elongated handle member 10 having a fixed jaw member 12 at one end and opposed sides 14, 15. Both pliers 5, 6 include a movable jaw member 16. In the case of pliers 5, jaw member 16 is pivotally connected by a pivot pin 20 to handle member 10 for movement on pivot axis a1 from an open position to a closed position in relation to jaw member 12 of pliers 5. In the case of pliers 6, jaw member 16 is pivotally connected by a pivot pin 22 to handle member 10 for movement on pivot axis a2 from an open position to a closed position in relation to jaw member 12 of pliers 6. In both cases, a movable handle 30 is pivotally connected to jaw member 16 by a pivot pin 32.

Each pliers 5, 6 also includes a conventional locking mechanism for releasably locking its movable jaw member 16 in the closed position while jaw members 12, 16 grip a workpiece. More particularly, the locking mechanism includes a conventional toggle link 40 pivotally connected at one end to handle 30 by a pivot pin 42, and which extends to a hidden distal end abutted by the hidden abutment end of adjustment screw 44 within handle member 10. A tension spring 45 linked a1 one to jaw member 16 and at the other hidden end lo handle member 10 conventionally serves to bias jaw member 16 to its open position when the jaw members are opened. A conventional release lever 46 is pivotally connected to handle 30 by a pivot pin 47 and is spring biased to the position shown in FIGS. 3–4. Lever 46 includes a protrusion 48 shaped to bear against link 40 when the lever is forcibly pivoted, thereby releasing jaw member 16 from a locked, closed position.

Locking mechanisms of the foregoing type, including details hidden in the present drawing, are well known to those skilled in the art. Accordingly, and also because the present invention is not considered to be dependent upon any particular locking mechanism, the mechanism will not be discussed in further detail. For those who are not fully skilled, reference may be made, for example, to U.S. Pat. No. 4,730,524 identified above, to patents cited or referred to therein, and to patents cited or referred to in such patents. As well, it may be noted that locking pliers like those illustrated in FIGS. 3–4, but without modification in accordance with the present invention, are available in the marketplace.

Figure 5:
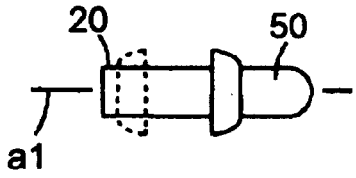
FIG. 5 is a side view of the combined bracing pin and pivot pin which are present in the locking plier shown in FIG. 4.
Figure 6:
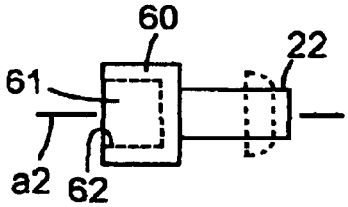
FIG. 6 is a side view of the combined pin socket and pivot pin which are present in the locking pliers shown in FIG. 3.
Figure 7:
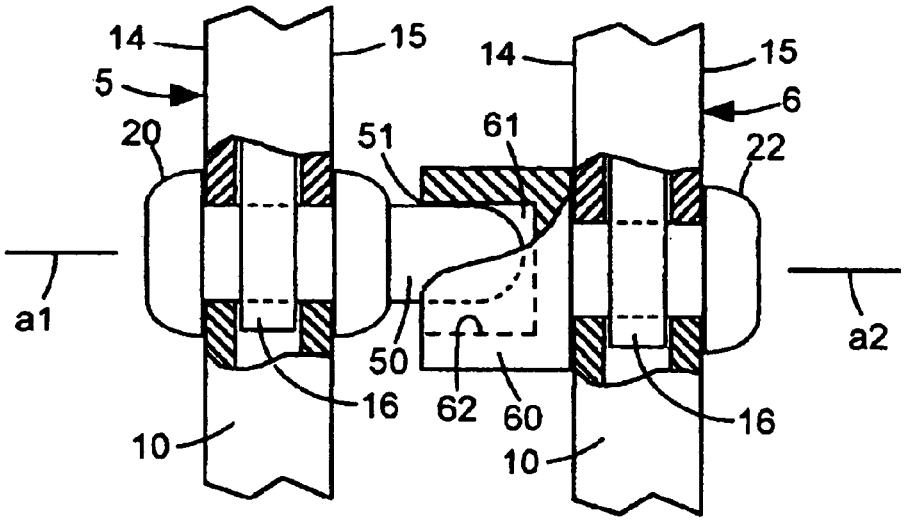
FIG. 7 is an enlarged view, partially sectioned and partially cut-away, showing the engagement between the bracing pin and the pin socket illustrated in FIG. 1.

Reference is now made to FIGS. 5–7 which focus upon modifications made in accordance with the present invention. In FIG. 5, pivot pin 20 is shown in solid outline prior to assembly with pliers 5. When assembled with pliers 5, the left hand side of pin 20 assumes the rivet head formation as shown in broken outline in FIG. 5 and in solid outline in FIG. 7. A cylindrical bracing pin 50 is integrally formed with pivot pin 20 and extends transversely away from side 15 of handle member 10 of pliers 5. The longitudinal axis of pin 50 is aligned with pivot axis a1. (In the absence of pin 50, pliers 5 would constitute prior art and would be representative of a conventional, commercially available, locking pliers).

In FIG. 6, pivot pin 22 is shown in solid outline prior to assembly with pliers 6. When assembled, the right hand side of pin 22 assumes the rivet head formation as shown in broken outline in FIG. 6 and in solid outline in FIG. 7. A pin socket member 60 is integrally formed with pivot pin 22 and extends transversely away from side 14 of handle member 10 of pliers 6. Socket member 60 includes a cylindrical socket 61, the axis of which is aligned with pivot axis a2 of pliers 6. (If socket member 60 was replaced by a simple rivet head, then pliers 6 would constitute prior art and would be representative of a conventional, commercially available, locking pliers).

It will be appreciated that the structure of existing locking pliers may be modified to include a bracing pin 50 and a pin socket member 60 without modification to handle 10 apart from that to pivot pins 20, 22.

As can be seen in FIGS. 1, 2 and 7, socket 61 is sized to longitudinally receive pivot pin 50 and to permit angular movement of the pin within the socket. Inner wall 62 of the socket provides a an abutment for pin 50: viz. along line 51 when pliers 5, 6 are positioned as shown in FIGS. 1 and 7; and at point 51' when the pliers are positioned as shown in FIG. 2.

In the position shown in FIGS. 1 and 7, the pliers extend in parallel and pivot axes a1, a2 necessarily extend in parallel. Such ajuxtaposition is suitable when a workpiece such as workpiece 100 offers a relatively large surface area to be gripped. In the position shown in FIG. 2, the pliers converge at an angle a to better facilitate a grip on relatively small workpiece 200. To enable such convergence while still providing a suitable abutment for pin 50, socket 61 has permitted pin 50 to be angularly moved within the socket through the same angle $\alpha$. The plane of such movement is perpendicular to the longitudinal axis of pin 50.

The use of the embodiment shown in FIGS. 1–7 will now be described. One example of use is generally illustrated in FIG. 1 and in more detail in FIG. 7. A second example is shown in FIG. 2. In each example, hole 101 or 102 as the case may be has been drilled through the associated workpiece 100, 200 by a clockwise rotating drill (not shown) which imparts a clockwise torque T1, T2 to the workpiece.

The clockwise direction of the torque determines where pin 50 should engage inner wall 62 (FIG. 7) of socket 61.

More particularly, if the torque direction is clockwise, then as indicated in the examples the pliers 5, 6 should be initially positioned by the user such that the upper side of pin 50 abuts inner wall 62. Conversely, if the torque direction is anticlockwise (not shown), then pliers 5, 6 should be initially positioned by the user such that the lower side of pin 50 abuts inner wall 62.

When actually performing the drilling operation, the user needs only to hold pliers 5 if the torque is clockwise, or pliers 6 if the torque in anticlockwise.

Torques may be applied to a workpiece not only by drilling operations but by grinding operations. If the torque is sufficient, the workpiece will be twisted from the grip of jaw members 12 coacting with jaw members 16 (see FIGS. 3–4). If the workpiece is gripped by a single one of pliers 5 or 6, then a relatively small torque may be sufficient to cause a loss of grip. However, if the workpiece is held in accordance with the present invention, then a significant improvement can be achieved.

Figure 3:
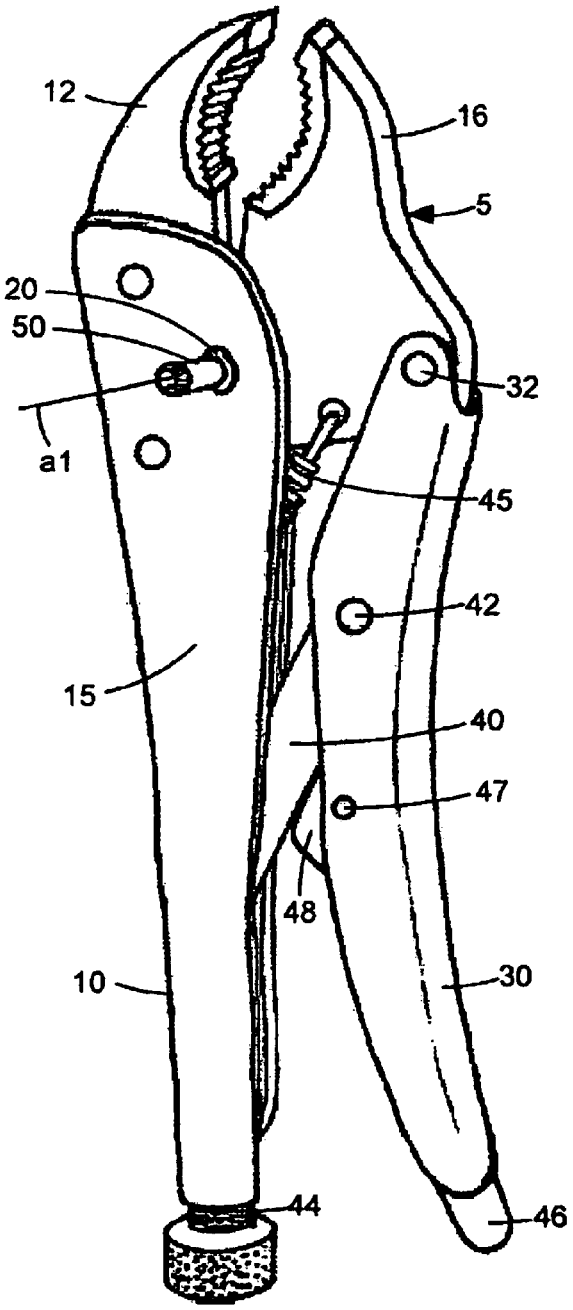
FIG. 3 is a perspective view of one of the locking pliers which forms part of the hand tool shown in FIGS. 1 and 2.
Figure 4:
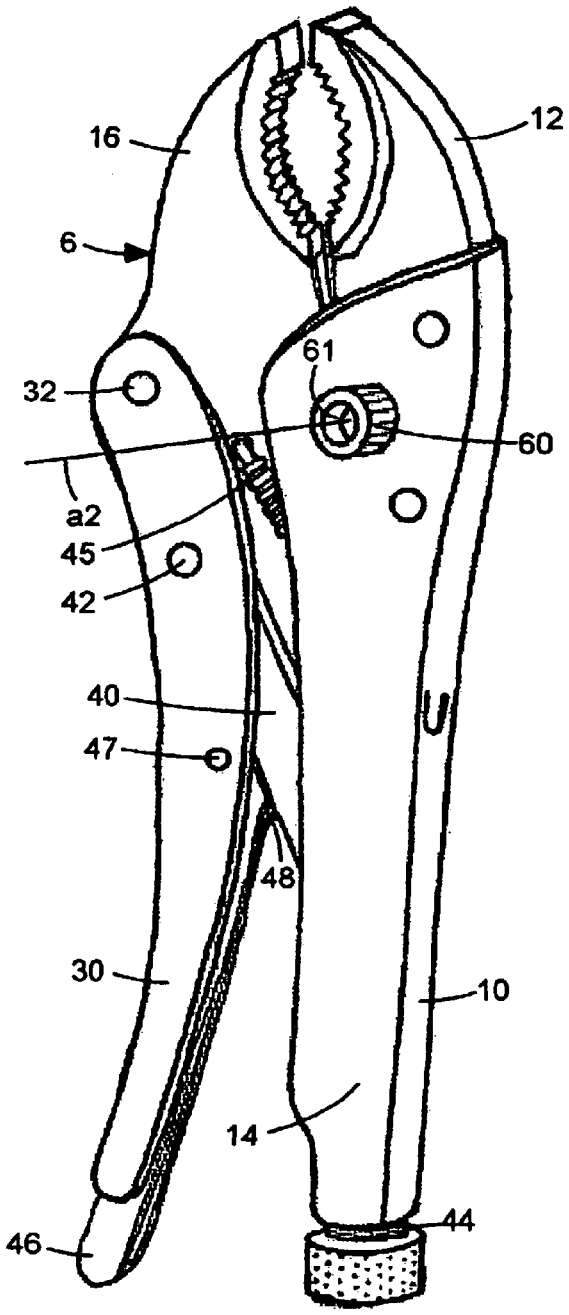
FIG. 4 is a perspective view of the other one of the locking pliers which forms the remaining part of the hand tool shown in FIGS. 1 and 2.

In a test case using locking pliers like those illustrated in FIGS. 3–4, the jaw members 12, 16 of the pliers had a purchase (gripping area) of about ½ inch by 1/16 inch. The pivot axis between the jaw members was located about 2½ inches rearwardly of the nose of the pliers. For a given gripping force, a clockwise torque of approximately 30 foot pounds was found sufficient to twist a workpiece like workpiece 200 (FIG. 2) from the grip of a single pliers. Not unsurprisingly, approximately double that torque was found sufficient to twist a similar workpiece from the combined grip of two pliers which were not braced in accordance with the present invention. But, when braced as shown in FIG. 2, it was found that a clockwise torque in excess of 100 foot pounds was required to twist the workpiece from the grip of the two pliers. A possible explanation is as follows:

As torque T2 increases, workpiece 200 is initially held in position simply by the gripping force of pliers 5, 6 and the resulting frictional resistance. However, when torque T2 reaches an amount that ordinarily would overcome such resistance and allow workpiece 200 to be pulled in a clockwise arc upwardly from the grip pliers 5 in FIG. 2, pin 50 and socket 60 provide a coupling between the pliers 5, 6 and the workpiece. In FIG. 2, this coupling results in a downward push at 51' by socket 61 of pliers 6 against pin 50 of pliers 5. The downward push mitigates the upward pull and, as a result, torque 2 can continue to increase while the workpiece remains securely held.

Variation 1

With reference to FIG. 1, one may question the need for socket 61. Fundamentally, there is no need so long as bracing pin 50 of pliers 5 can be brought into contact with a suitable abutment carried by pliers 6 while both pliers maintain an effective grip on a workpiece. However, a socket for receiving the bracing pin is considered desirable because it offers a guide for properly positioning and aligning pliers 5, 6 during the process of gripping a workpiece.

Variation 2

Figure 8:
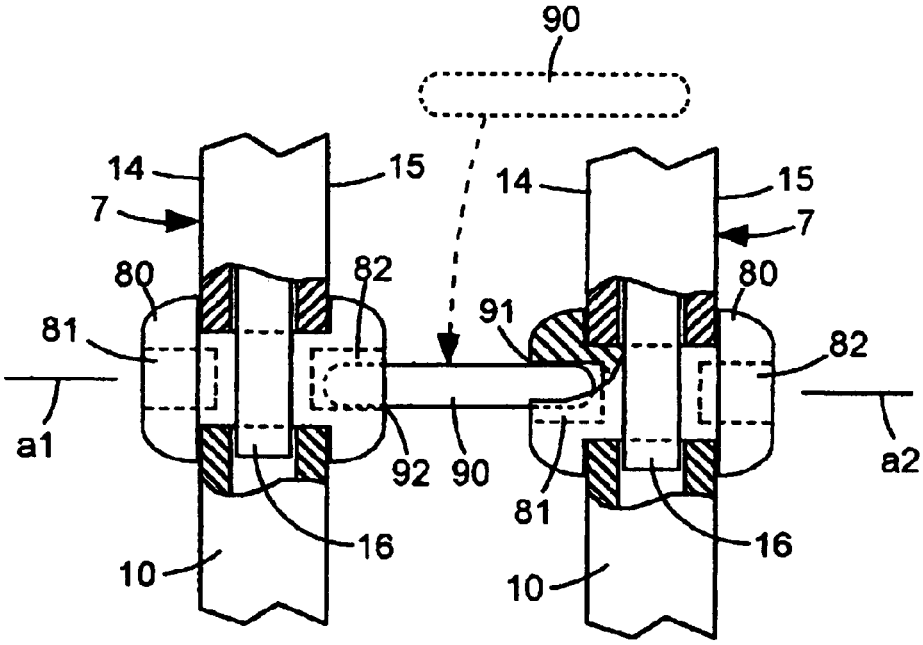
FIG. 8 is an enlarged view, partially sectioned and partially cut-away, showing an alternative construction for pliers and a bracing pin in accordance with the present invention.

FIG. 8 illustrates an alternative embodiment which comprises two substantially identical pliers 7, 7 and a cylindrical bracing pin 90. But for the substitution of pivot pin 80 for pivot pin 20 and bracing pin 50 in the case of pliers 5, and the substitution of pivot pin 80 for pivot pin 22 and socket 60 in the case of pliers 6, pliers 7, 7 may be considered to be substantially identical to pliers 5, 6 for purposes of the present discussion. Accordingly, further details of pliers 7, 7 are not shown or described herein.

In FIG. 8, each pivot pin 80 includes cylindrical pin sockets 81, 82 drilled into opposed ends of the pivot pin. Sockets 81, 82 are sized to longitudinally receive either end of bracing pin 90. As depicted in FIG. 8, one end of pin 90 is received within socket 82 of one of the pliers 7, and is abuttingly engaged within the socket at 92. The other end of pin 90 is received within socket 81 of the other of pliers 7, and is abuttingly engaged within the socket at 91. The positions of abutment shown in FIG. 8 are those which would be used if pliers 7, 7 concurrently held a workpiece like workpiece 100 while subjected to a clockwise torque.

Sockets 81, 82 are sized not only to longitudinally receive either end of bracing pin 90 but also to permit angular movement of the pin within the sockets just as previously described bracing pin 50 may move angularly within previously described socket 61. Thus, while pliers 7, 7 extend in parallel as shown in FIG. 7, 7, it will be understood that they may be angled towards each other as in the case of pliers 5, 6 as shown in FIG. 2.

One disadvantage of the embodiment shown in FIG. 8 is that it requires a separate and distinct element, namely bracing pin 90, which is unconnected to either one of the pliers. By itself, pin 90 may be easily lost or misplaced. Also, unless the diameters of the jaw pivot pins are increased, the diameter of pivot pin 90 necessarily may be relatively small (compared to pin 50) with a consequent reduction in shear strength. On the other hand, since pliers 7, 7 are substantially identical in construction, they are interchangeable and there is no left-handedness or right-handedness in their use as in the case of the embodiment shown in FIGS. 1–7.

Variation 3

In the embodiment comprising pliers 5, 6 and in the embodiment comprising pliers 7, 7, the associated bracing pin (50, 90, as the case may be) and the associated pin socket(s) (61, 81, 82, as the case may be) are positioned in or close to alignment with the pivot axis (a1, a2, as the case may be). This positioning is considered desirable not only because it provides a significant improvement in overall grip but also because various styles of existing locking pliers can be modified in accordance with the present invention merely by replacing existing pivot pins with suitably modified pivot pins. No other part of the existing construction need be modified.

However, it will be understood by those skilled in the art that somewhat more or somewhat less improved performance may be realized if a bracing pin is located elsewhere than in axial alignment with the jaw member pivot pin. For example, if a transversely oriented bracing pin was positioned forwardly of bracing pin 50 as shown in FIG. 1 (viz. towards workpiece 100), then handle member 10 would require structural modification and the expectation would be a somewhat degraded grip performance (but still improved over that which would be achieved without any bracing pin). Conversely, if a transversely oriented bracing pin was positioned rearwardly of bracing pin 50 as shown in FIG. 1, then the expectation would be a somewhat improved grip performance. But, handle member 10 would still require structural modification in such a case. Moreover, as the bracing pin was moved further rearwardly another difficulty presents itself. Specifically, it would not be possible on the one hand to have the close parallel relationship between pliers as shown in FIG. 1 and, on the other, to spread the pliers by an angle $\alpha$ as shown in FIG. 2 and yet maintain bracing contact between the pliers.

Other Variations

It is to be understood that various modifications and changes can be made to the form, details, arrangement and proportion of the various parts described with reference to the embodiments described above without departing from the scope of the present invention. A variety of styles or types of locking pliers known in the prior art may be modified in accordance with the present invention, and the invention is not limited in its implementation to the general type or style of locking pliers shown by way of example in FIGS. 3 and 4. The invention is not to be construed as limited to the particular embodiments that have been described and should be understood as encompassing all those embodiments which are within the spirit and scope of the claims that follow.

I claim:

1. A hand too for portably holding a workpiece, said tool comprising:

(a) first and second locking pliers for concurrently gripping said workpiece with a lockable grip, each of said pliers comprising:

(i) a first handle member having a fixed jaw member at one end thereof and opposed sides;

(ii) a movable jaw member pivotally connected to said first handle member for movement on a pivot axis between an open position and a closed position in relation to said fixed jaw member;

(iii) a second handle member pivotally connected to said movable jaw member for moving said movable jaw member between said open and closed positions; and, (iv) a locking mechanism for releasably locking said movable jaw member in said closed position; and, (b) a bracing member extending on a longitudinal axis transversely away from a side of the first handle member of one of said pliers for restraining relative movement between said pliers by engaging an abutment carried by the first handle member of the other one of said pliers while both of said pliers concurrently grip said workpiece, said longitudinal axis being aligned with said pivot axis or said one of said pliers.

2. A hand tool for portably holding a workpiece, said tool comprising:

(a) first and second locking pliers for concurrently gripping said workpiece with a lockable grip, each of said pliers comprising:

(i) a first handle member having a fixed jaw member at one end thereof and opposed sides;

(ii) a movable jaw member pivotally connected to said first handle member for movement on a pivot axis between an open position and a closed position in relation to said fixed jaw member;

(iii) a second handle member pivotally connected to said movable jaw member for moving said movable jaw member between said open and closed positions; and, (iv) a locking mechanism for releasably locking said movable jaw member in said closed position;

(b) an elongated bracing pin extending on a longitudinal axis transversely away from a side of the first handle member of one of said pliers, said longitudinal axis being aligned with said pivot axis said one said pliers; and, (c) a pin abutment fixed to a side of the first handle member of the other one of said pliers for abuttingly engaging said bracing pin while both of said pliers concurrently grip said workpiece.

3. A hand tool as defined in claim 2, wherein said pin abutment comprises a pin socket sized to longitudinally receive said pin.

4. A hand tool as defined in claim 3, wherein said socket is sized to permit angular movement of said pin within said socket in a plane perpendicular to said longitudinal axis.

5. A hand tool as defined in claim 3, wherein:

(a) said bracing pin is connected to said pivot pin of the first one of said pliers, and has a pin axis aligned with said pivot axis of said first one of said pliers; and (b) said pin socket is connected to said pivot pin of the second one of said pliers, and has a socket axis aligned with said pivot axis of the second one of said pliers.

6. A hand tool as defined in claim 5, wherein said socket is sized to permit angular movement of said pin within said socket about an axis perpendicular to said longitudinal axis.

7. A hand tool as defined in claim 5, wherein:

(a) said bracing pin is integrally formed with said pivot pin of said first one of said pliers; and, (b) said pin socket is integrally formed with said pivot pin of said second one of said pliers.

8. A hand tool as defined in claim 7, wherein said socket is sized to permit angular movement of said pin within said socket in a plane perpendicular to said longitudinal axis.

9. A hand tool for portably holding a workpiece, said tool comprising:

(a) first and second locking pliers for concurrently gripping said workpiece with a lockable grip, each of said pliers comprising:

(i) a first handle member having a fixed jaw member at one end thereof and opposed sides;

(ii) a movable jaw member pivotally connected to said first handle member for movement on a pivot axis between an open position and a close position in relation to said fixed jaw member, (iii) a second handle member pivotally connected to said movable jaw member for moving said movable jaw member between said open and closed positions; and, (iv) a locking mechanism for releasably locking said movable jaw member in said closed position;

(b) a first pin socket connected to the first handle member of a first one of said pliers;

(c) a second pin socket connected the first handle member of a second one of said pliers; and, (d) an elongated bracing pin extending on a longitudinal axis, said bracing pin having one end longitudinally receivable within side first pin socket while an opposed end of said bracing pin is longitudinally received within said second pin socket;

said pin socket for concurrently abuttingly engaging said bracing pin while both of said pliers concurrently grip said workpiece.

10. A hand tool as defined in claim 9, wherein said sockets are sized to permit angular movement of said pin within said sockets in a plane perpendicular to said longitudinal axis.

11. A hand tool as defined in claim 9, wherein:

(a) said first pin socket is connected to said pivot pin of said first one of said pliers, and has a pin axis aligned with said pivot axis of said one of said first one of said pliers; and, (b) said second pin socket is connected to said pivot pin of said second one of said pliers, and has a socket axis aligned with said pivot axis of said second one of said pliers.

12. A hand tool as defined in claim 11, wherein said sockets are sized to permit angular movement of said pin within said sockets in a plane perpendicular to said longitudinal axis.

13. A hand tool as defined in claim 12, wherein:

(a) said first pin socket is integrally formed with said pivot pin of said first one of said pliers; and, (b) said second pin socket is integrally formed with said pivot pin of said second one of said pliers.

* * * * *

UNITED STATES PATENT AND TRADEMARK OFFICE

CERTIFICATE OF CORRECTION

PATENT NO. : 6,776,403 B1
DATED : August 17, 2004
INVENTOR(S) : George Neufeld

It is certified that error appears in the above-identified patent and that said Letters Patent is hereby corrected as shown below:

Column 1,
Line 23, after "workpiece" insert comma punctuation -- , --.
Line 54, after "workman uses", delete "an".
Line 62, after "hand tool" delete "is".

Column 3,
Line 11, change "plier" to -- pliers --

Column 4,
Line 50, change "ajuxtaposition" to -- a juxtaposition --
Line 53, change "angle a" to -- angle α --.

Column 7,
Line 30, change "pivot axis or" to -- pivot axis of --
Line 51, change "axis said one said" to -- axis of said one of said --

Column 8,
Line 24, change "close" to -- closed --.
Line 41, change "socket" to -- sockets --.

Signed and Sealed this

Thirtieth Day of November, 2004

JON W. DUDAS
*Director of the United States Patent and Trademark Office*